US010280615B2

(12) United States Patent
Strickland

(10) Patent No.: US 10,280,615 B2
(45) Date of Patent: May 7, 2019

(54) CONCRETE FORMWORK STEEL STUD AND SYSTEM

(71) Applicant: iSPAN SYSTEMS LP, Princeton (CA)

(72) Inventor: Michael R. Strickland, Richmond Hill (CA)

(73) Assignee: ISPAN SYSTEMS LP, Princeton, ON (CA)

( * ) Notice: Subject to any disclaimer, the term of this patent is extended or adjusted under 35 U.S.C. 154(b) by 0 days.

(21) Appl. No.: 15/366,889

(22) Filed: Dec. 1, 2016

(65) Prior Publication Data

US 2017/0328060 A1 Nov. 16, 2017

Related U.S. Application Data

(60) Provisional application No. 62/334,974, filed on May 11, 2016.

(51) Int. Cl.

| | |
|---|---|
| ***E04B 2/86*** | (2006.01) |
| ***E04C 5/07*** | (2006.01) |
| ***E04G 11/06*** | (2006.01) |
| ***E04G 17/065*** | (2006.01) |
| ***E04C 3/09*** | (2006.01) |

(Continued)

(52) U.S. Cl.

CPC ..... *E04B 2/8635* (2013.01); *E04C 3/09* (2013.01); *E04C 5/073* (2013.01); *E04C 5/168* (2013.01); *E04G 11/06* (2013.01); *E04G 17/065* (2013.01); *E04B 2002/8676* (2013.01); *E04C 2003/0473* (2013.01)

(58) Field of Classification Search

CPC ..... E04B 2/8635; E04G 17/065; E04G 11/06; E04C 5/073

See application file for complete search history.

(56) References Cited

U.S. PATENT DOCUMENTS

| | | | |
|---|---|---|---|
| 681,355 | A | 8/1901 | Turnbull |
| 1,077,404 | A | 11/1913 | Goldsmith |

(Continued)

FOREIGN PATENT DOCUMENTS

| | | |
|---|---|---|
| AU | 295730 | 11/1963 |
| CA | 2502115 | 5/2006 |

(Continued)

OTHER PUBLICATIONS

Bailey Stud Brochure "The Platinum Framing System".

(Continued)

*Primary Examiner* — Patrick J Maestri

(74) *Attorney, Agent, or Firm* — Hill & Schumacher

(57) ABSTRACT

A formwork stud system includes a plurality of studs, a top channel, a bottom channel and a plurality of horizontal and vertical rebars. At least one of the plurality of studs is a formwork stud. The formwork stud includes a web and a pair of flanges. The web has opposed side portions extending from the top of the formwork stud to the bottom of the formwork stud and a plurality of lateral spaced apart connectors extending between the opposed side portions. The opposed side portions and the lateral spaced apart connectors define a plurality of spaced apart holes. The holes are configured to allow concrete to flow therethrough. The pair of flanges extend generally orthogonally from the opposed side portions of the web.

15 Claims, 16 Drawing Sheets

(51) Int. Cl.
*E04C 5/16* (2006.01)
*E04C 3/04* (2006.01)

(56) References Cited

U.S. PATENT DOCUMENTS

| | | | | |
|---|---|---|---|---|
| 1,820,700 | A | 8/1931 | Hatch | |
| 2,108,373 | A | 2/1938 | Greulich | |
| 2,177,277 | A | 10/1939 | Burke | |
| 3,043,408 | A | 7/1962 | Attwood | |
| 3,049,198 | A | 8/1962 | Dobbins et al. | |
| 3,243,930 | A | 4/1966 | Slowinski | |
| 3,341,997 | A | 9/1967 | Pestel et al. | |
| 3,623,290 | A | 11/1971 | Downing, Jr. | |
| 3,680,271 | A | 8/1972 | Satchell | |
| 3,852,935 | A | 12/1974 | Jones | |
| 3,925,875 | A | 12/1975 | Doke | |
| 3,974,602 | A * | 8/1976 | Pohl | E04B 1/34315 52/143 |
| 4,011,704 | A | 3/1977 | O'Konski | |
| 4,016,700 | A | 4/1977 | Blomstedt | |
| 4,329,824 | A | 5/1982 | Lowe | |
| 4,455,806 | A | 6/1984 | Rice | |
| 4,580,388 | A | 4/1986 | Maisch | |
| 4,619,098 | A | 10/1986 | Taylor | |
| 4,713,921 | A | 12/1987 | Minialoff et al. | |
| 4,783,940 | A | 11/1988 | Sato et al. | |
| 4,793,113 | A | 12/1988 | Bodnar | |
| 4,809,476 | A | 3/1989 | Satchell | |
| 4,962,622 | A | 10/1990 | Albrecht et al. | |
| 4,986,051 | A | 1/1991 | Meyer et al. | |
| 5,157,883 | A | 10/1992 | Meyer | |
| 5,285,615 | A | 2/1994 | Gilmour | |
| 5,315,804 | A | 5/1994 | Atalla | |
| 5,325,651 | A | 7/1994 | Meyer et al. | |
| 5,463,837 | A | 11/1995 | Dry | |
| 5,527,625 | A | 6/1996 | Bodnar | |
| 5,687,538 | A | 11/1997 | Frobosilo et al. | |
| 5,689,990 | A | 11/1997 | Deeley | |
| 6,073,414 | A | 6/2000 | Garris et al. | |
| 6,183,879 | B1 | 2/2001 | Deeley | |
| 6,381,916 | B1 | 5/2002 | Maisch et al. | |
| 6,481,175 | B2 | 11/2002 | Potter et al. | |
| 6,647,675 | B1 | 11/2003 | Castellanos | |
| 6,978,581 | B1 * | 12/2005 | Spakousky | E04B 2/8617 52/405.1 |
| 8,225,581 | B2 | 7/2012 | Strickland et al. | |
| 8,683,774 | B2 | 4/2014 | Strickland et al. | |
| 8,745,959 | B2 | 6/2014 | Strickland et al. | |
| 2005/0081477 | A1 | 4/2005 | St. Quinton | |
| 2006/0191236 | A1 | 8/2006 | Surowiecki | |
| 2008/0110126 | A1 | 5/2008 | Howchin | |
| 2008/0250738 | A1 | 10/2008 | Howchin | |
| 2009/0107065 | A1 * | 4/2009 | LeBlang | E04B 1/165 52/252 |
| 2009/0126315 | A1 | 5/2009 | Knauf | |
| 2009/0165416 | A1 * | 7/2009 | Porter | E04B 2/7453 52/481.1 |
| 2009/0249743 | A1 | 10/2009 | Bodnar | |

FOREIGN PATENT DOCUMENTS

| | | |
|---|---|---|
| CA | 2568111 | 4/2014 |
| CA | 2584677 | 4/2014 |
| DE | 4271350 | 6/1968 |
| DE | 3442355 | 1/1986 |
| DE | 29808344 | 9/1998 |
| DE | 10013991 | 4/2001 |
| DE | 102005016175 | 10/2006 |
| GB | 2171731 | 9/1986 |
| GB | 2389127 | 3/2003 |
| WO | 8101582 | 6/1981 |
| WO | 8203347 | 10/1982 |
| WO | 87903920 | 5/1989 |
| WO | 9508409 | 3/1995 |
| WO | 9734059 | 9/1997 |
| WO | 2004113637 | 12/2004 |
| WO | 2005042869 | 5/2005 |

OTHER PUBLICATIONS

Cormet Partitions.
"Light Gauge Steel Framing for Housing " Burstrand, SBI Publication 170.
Tab 30 "Montants Maxi-Scw Pour Une" Protektorwerk copyright 2004.
Tab 31 "Knauf Metal Stud Partitions" Technical Data Sheet W11 Edition Jul. 2005.
Tab 32 "Roll Forming Handbook" Taylor & Francis Group.
Tab 42 "Commercial Metal Stud Framing" Ray Clark, copyright 1999 Craftsman Book Company.
Tab 44 "Cormet" Complete Metal Systems.
C.Y. Lin. Axial Capacity of Concrete Filled Cold-Formed Steel Columns. Ninth International Specialty Conference on Cold-Formed Steel Structures. St. Louis, Missouri, USA pp. 443-457. Nov. 8-9, 1988.
Halmos, G. Editor. Roll Forming Handbook. Taylor 7 Francis Group. p. 1. Nov. 29, 2005.

* cited by examiner

CONCRETE FORMWORK STEEL STUD AND SYSTEM

FIELD OF THE DISCLOSURE

This disclosure relates to roll formed steel members and in particular roll formed steel studs and steel systems for use as concrete formwork.

BACKGROUND

Concrete walls are commonly used in all types of building construction throughout the world. Concrete shear walls provide a cost effective means to provide fire protected lateral resistance systems for building structures. To make concrete walls, beams and columns formwork is used to retain poured concrete into its desired shape. Formwork is typically stripped away from the concrete after it sets and the formwork is reused.

In the past concrete walls were formed with planks or plywood fastened to vertical and horizontal spaced structural members that provide a form for the wet concrete. When the concrete is being poured and it is wet, for a typical 10 foot high wall 10" thick, the pressures at the bottom inside faces of the form can be greater than 350 pounds per square inch. Formwork needs to be robust to take the inherently high pressures and abuse, so that a concrete pour does not experience blow-outs. Typically the two opposing sides or faces of the formwork wall are tied together with metal components such as threaded rods or wires. The ties pass from outside one wall to the outside of the opposite wall, after the ties are passed through the walls and through the vertical or horizontal structural members and fixed to restrain the form walls relative to each other while the concrete is wet. Sometimes the metal ties are left in place after the wall is poured.

While the conventional formwork for concrete walls has worked well for many years, they have some disadvantages. If the space between adjacent buildings is tight, the form work might be left in place after the construction is finished. While structurally this works it is not particularly aesthetically pleasing. As well, erecting the formwork on site can be time consuming and in a busy construction market it can be difficult to get the formwork trades. The availability of the formwork trades can significantly affect the flow of work on the job site.

Accordingly it would be advantageous to provide an alternative to the prior art formwork systems.

SUMMARY

The present disclosure relates to a formwork stud system. The formwork stud system includes a plurality of studs, a top channel, a bottom channel and a plurality of horizontal and vertical rebars. At least one of the plurality of studs is a formwork stud. The formwork stud includes a web and a pair of flanges. The web has opposed side portions extending from the top of the formwork stud to the bottom of the formwork stud and a plurality of lateral spaced apart connectors extending between the opposed side portions. The opposed side portions and the lateral spaced apart connectors define a plurality of spaced apart holes. The holes are configured to allow concrete to flow therethrough. The pair of flanges extend generally orthogonally from the opposed side portions of the web.

The plurality of studs have opposed faces and the formwork stud system may further include sheathing attached to at least one face thereof. Alternatively sheathing may be attached to both of the opposed faces. The sheathing may be structural board, a foam filled panel with metal on either side thereof or a corrugated wall. The corrugated wall may include a profiled foam rubber strip.

The formwork stud system may be constructed off site.

The holes in the may be generally rectangular. The holes in web of each formwork stud may further include at least one divot each for receiving the rebars. Alternatively, the holes in web of each formwork stud may include a plurality of divots for receiving the rebars. The formwork stud may also include tie holes proximate to each of the divots for receiving a rebar tie.

The present disclosure also relates to a formwork stud. The formwork stud has a web and a pair of flanges. The web has opposed side portions extend from the top to the bottom of the formwork stud and a plurality of lateral spaced apart connectors extend therebetween. The opposed side portions and the lateral spaced apart connectors define a plurality of spaced apart holes. The holes are configured to allow concrete to flow therethrough. The pair of flanges extend generally orthogonally from the opposed side portions of the web.

Each of the plurality of spaced apart holes may include at least one divot formed therein configured to receive a rebar. Alternatively, each of the plurality of spaced apart holes may include a plurality of divots. Each divot may have a pair of rebar tie holes proximate thereto.

The web may have between 70 and 90% removed to form the plurality of spaced apart holes. More specifically, the web may have 85% removed to form the plurality of spaced apart holes.

The formwork stud may include a pair of opposed lips extending inwardly from the pair of flanges.

The present disclosure relates also relates to a method of producing a formwork stud having a predetermine shape which includes a web having at least one hole formed therein and configured to allow concrete to flow therethrough. The method includes the steps of:

punching at least a first hole in a piece of steel sheet material;

punching a second hole in the piece of steel sheet material such that the second hole connects with the first hole to form double punch hole;

shaping the sheet material into a predetermined shape.

The method may further include the step of punching a third hole in the sheet material such that the third hole connects with the double punch hole to form a triple punch hole.

The method may further including the step of punching a hole to form a one punch hole that is spaced from the first hole.

The steps may be repeated to create a plurality of spaced apart holes.

The predetermined shape may be a C-shaped member having a web and opposed flanges. The C-shaped member may further include opposed lips extending inwardly from the flanges.

Further features will be described or will become apparent in the course of the following detailed description.

BRIEF DESCRIPTION OF THE DRAWINGS

The embodiments will now be described by way of example only, with reference to the accompanying drawings, in which.

DETAILED DESCRIPTION

Figure 1:
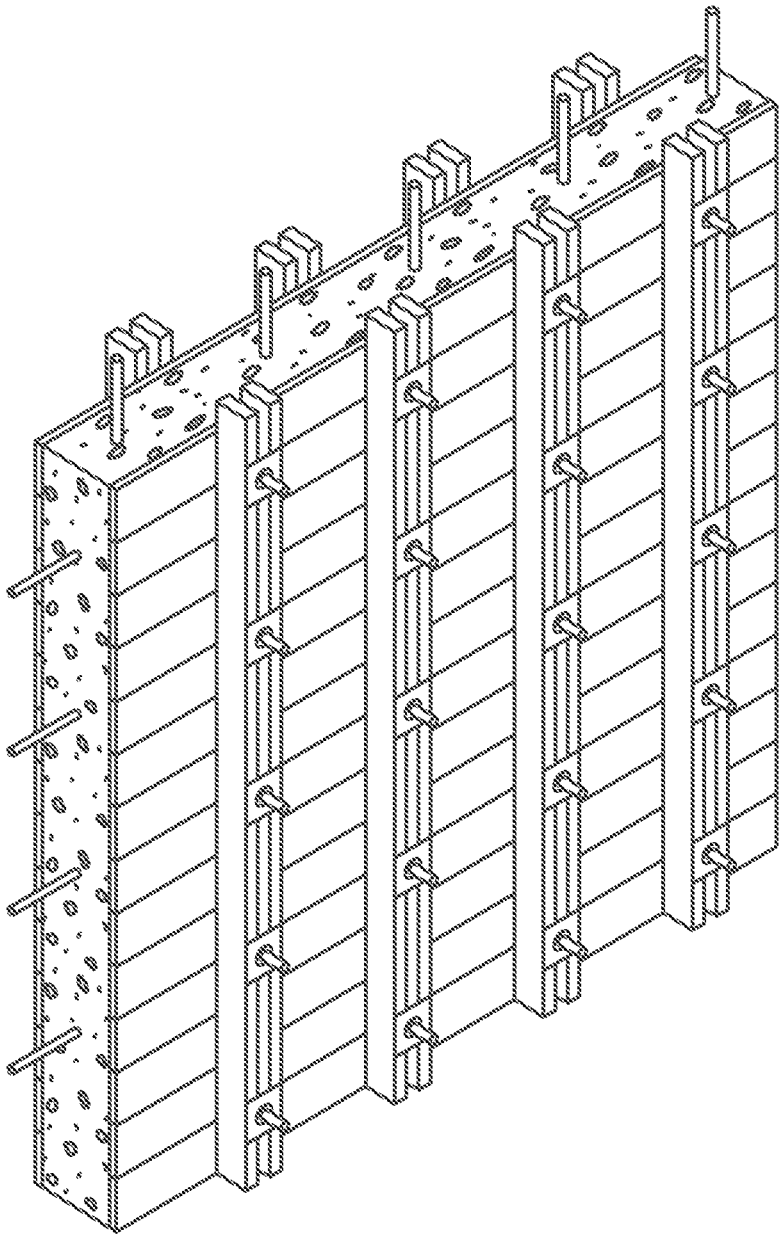
FIG. 1 (PRIOR ART)
FIG. 1 is a perspective view of a prior art formwork.
Figure 2:
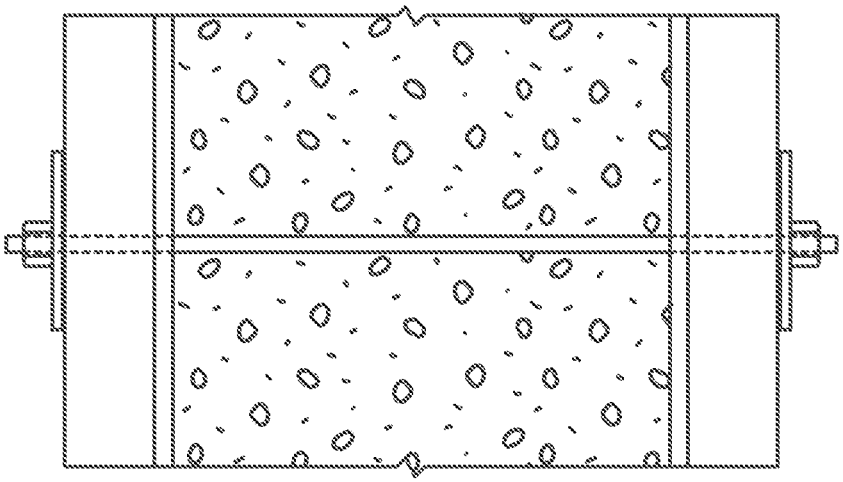
FIG. 2 (PRIOR ART)
FIG. 2 is a sectional view of the prior art formwork of FIG. 1.
Figure 3:
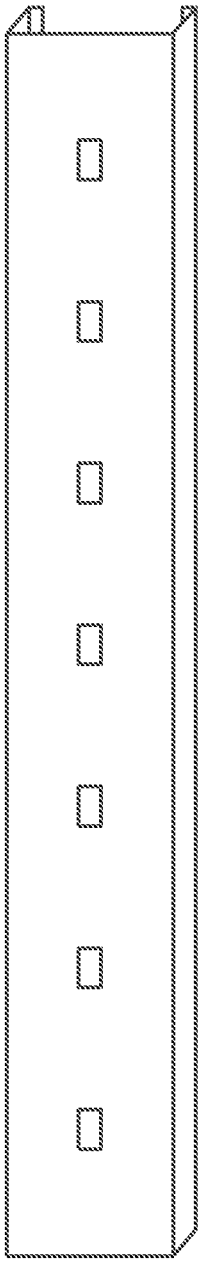
FIG. 3 (PRIOR ART)
FIG. 3 is a perspective view of a prior art stud with small square holes spaced apart axially along the web.
Figure 4:
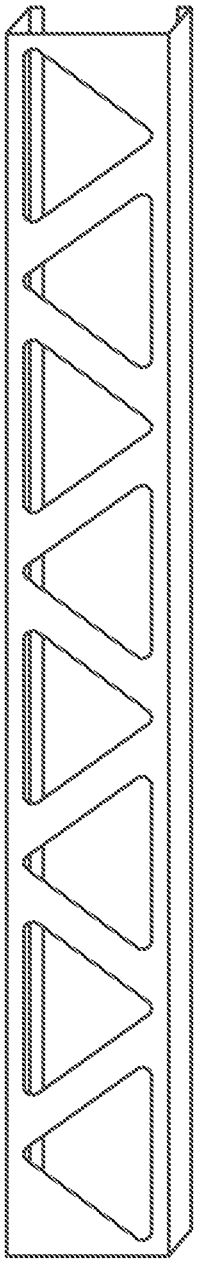
FIG. 4 (PRIOR ART)
FIG. 4 is a perspective view of another prior art stud showing generally triangular holes spaced axially along web.
Figure 5:
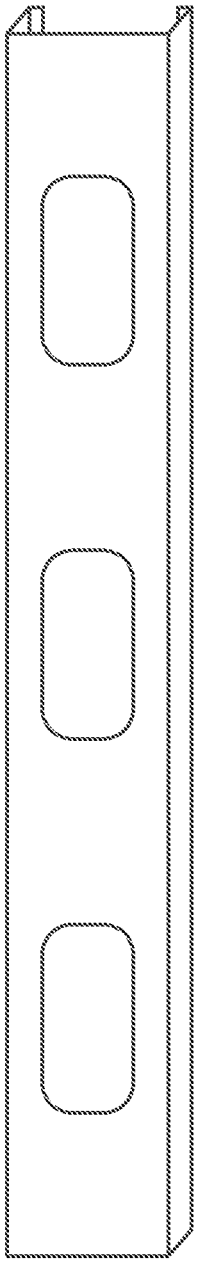
FIG. 5 (PRIOR ART)
FIG. 5 is a perspective view of another prior art stud showing generally large rectangular holes spaced apart axially along the web.

A typical prior art formwork system is shown in FIGS. 1 and 2. The prior art system shows a wooden system that is erected and then filled with concrete, removed from the set concrete and then moved to a new location to be filled again. Typical prior art roll formed studs are shown in FIGS. 3, 4 and 5. These studs are generally used for walls wherein boards are attached to one or both sides or faces. These studs are not typically designed for structural walls that are filled with concrete.

The studs shown in FIGS. 6 to 9 are for use in a stay-in-place formwork system that is designed to be filled with concrete. The stay-in-place formwork studs are created from roll formed light steel frame members. The formwork studs can have a number of different configurations depending on where each is positioned in a formwork wall system. The formwork stud system uses a plurality of spaced apart studs and vertical and horizontal reinforcing bars. The particular stud used will depend on where it is in the formwork stud system.

Figure 6:
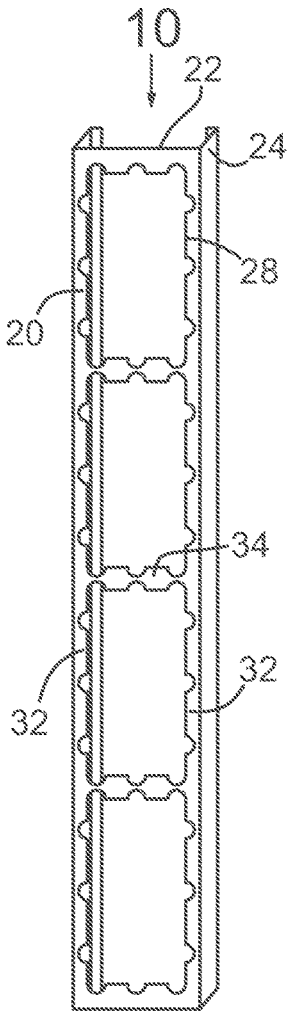
FIG. 6 is a perspective view of a formwork stud with a plurality of generally rectangular holes spaced apart along the web for use in a formwork system.
Figure 10:
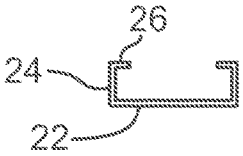
FIG. 10 is a top of view the formwork stud of FIG. 6.

Formwork stud 20 shown in FIG. 6 would be an intermediate formwork stud. Formwork stud 20 is a generally C-shaped stud having a web 22, opposed flanges 24 and opposed lips 26 as best seen in FIG. 10. The opposed flanges 24 extend generally orthogonally to the web 22. The lips 26 extend inwardly from the flanges 24 and generally orthogonally thereto. In formwork stud 20 there a plurality of large generally rectangular holes 28 that are spaced apart and formed in the web 22. The web material is removed such that when filled with concrete the concrete can flow freely between and through the holes 28 in the studs. Holes 28 are configured such that between 70% to 90% and preferably about 85% of the web material is removed where concrete is on either side of the stud so that there is continuity in the concrete. In contrast with prior art studs that do not allow the concrete to flow freely therebetween the wall will effectively be broken into several slender compartments between the studs.

Web 22 has opposed side portions 32 extending from the top of the formwork stud to the bottom of the formwork stud and a plurality of lateral spaced apart connectors 34 extending between the opposed side portions. The opposed side portions 32 and the lateral spaced apart connectors 34 define a plurality of spaced apart holes 28 and the holes are configured to allow concrete to flow therethrough.

Figure 7:
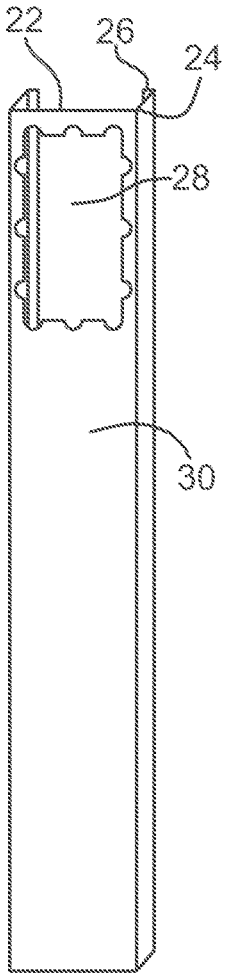
FIG. 7 is a perspective view of an alternate formwork stud with a generally rectangular hole in the web for use in a formwork system.

An alternate formwork stud 30 is shown in FIG. 7. Formwork stud 30 is similar to formwork stud 20 but with only one hole 28. Formwork stud 30 has a cross section similar to that of formwork stud 20 shown in FIG. 10 and described above. It will be appreciated by those skilled in the art that the number of holes 28 and the position of the holes 28 can vary depending on where, structural beams, doors or windows or other openings are positioned in the wall.

Figure 9:
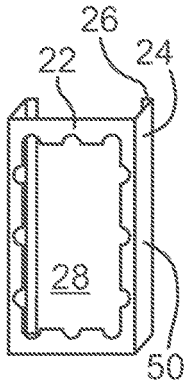
FIG. 9 is a perspective view of a short formwork stud with a generally rectangular hole in the web for use in a formwork system.

A short formwork stud 50 is shown in FIG. 9. Formwork stud 50 is similar to the formwork stud 20 but shorter. Formwork stud 50 has a cross section similar to that of formwork stud 20 shown in FIG. 10 and described above. It will be appreciated by those skilled in the art that the length of the short formwork stud 50 can vary depending on the location. The short formwork stud 50 includes at least one hole 28 formed therein. The number of holes 28 can vary depending on the length of the short formwork stud 50. As well the size of the holes 28 might vary so that the concrete can flow therethrough and that 70 to 90% and preferably 85% of the material is removed. The holes 28 shown herein are generally rectangular and may vary in length. However, it will be appreciated by those skilled in the art that other shapes of holes would also work.

Figure 8:
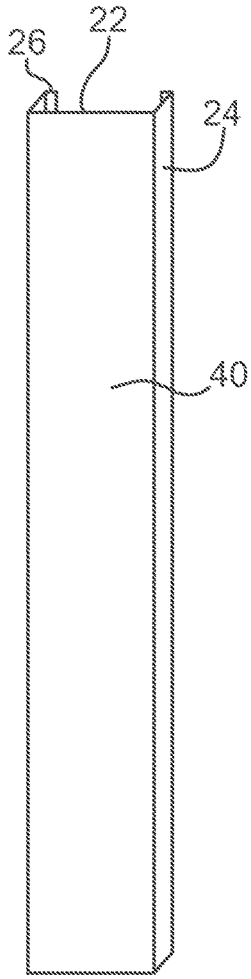
FIG. 8 is a perspective view of formwork stud with a solid web for use in a formwork system.

FIG. 8 shows an end formwork stud 40. The end formwork stud 40 is similar to formwork stud 20 but with a solid web 22. Formwork stud 40 has a cross section similar to that of formwork stud 20 shown in FIG. 10 and described above.

End formwork stud 40 is similar to a conventional stud but is used at the end of the concrete formwork stud system for containing the concrete.

Figure 12:
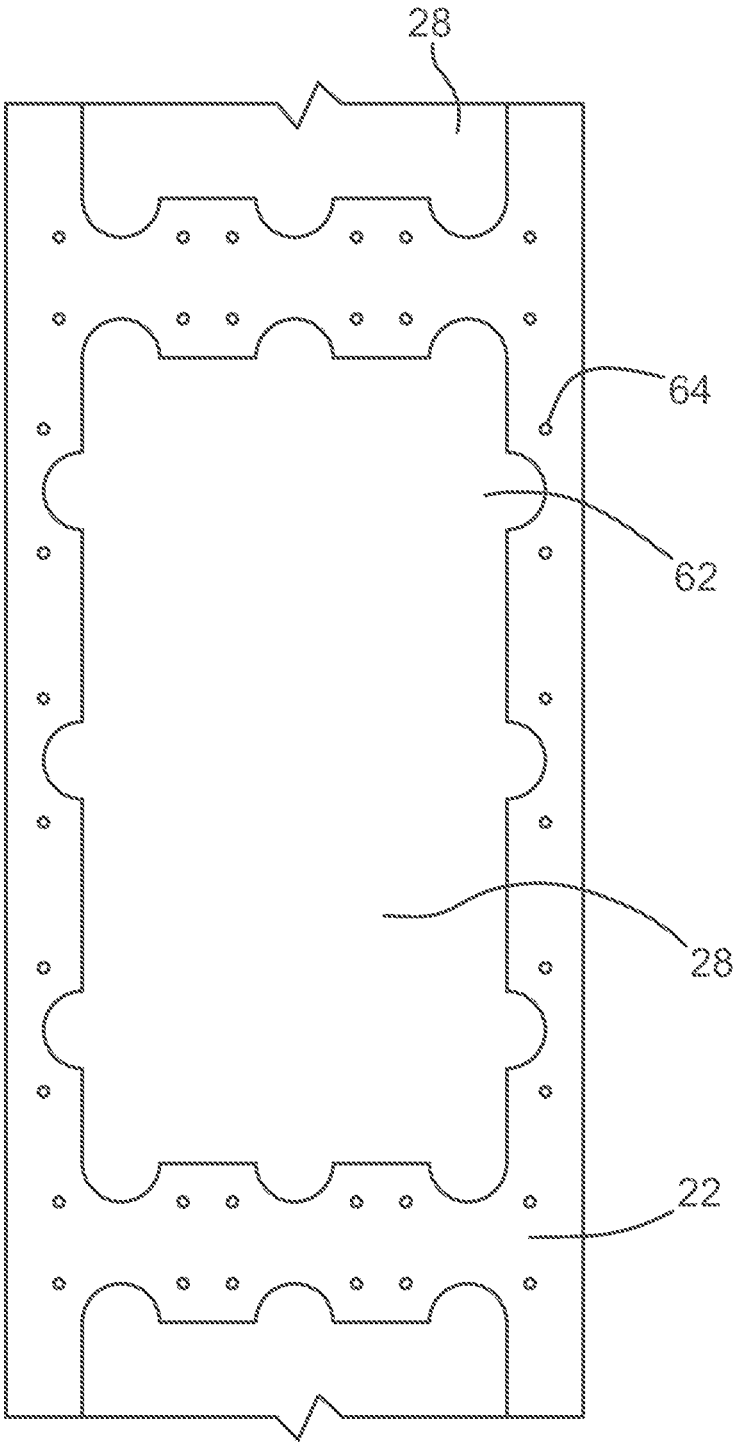
FIG. 12 is an enlarged front view of the generally rectangular hole used in the formwork studs for use in a formwork system.
Figure 13:
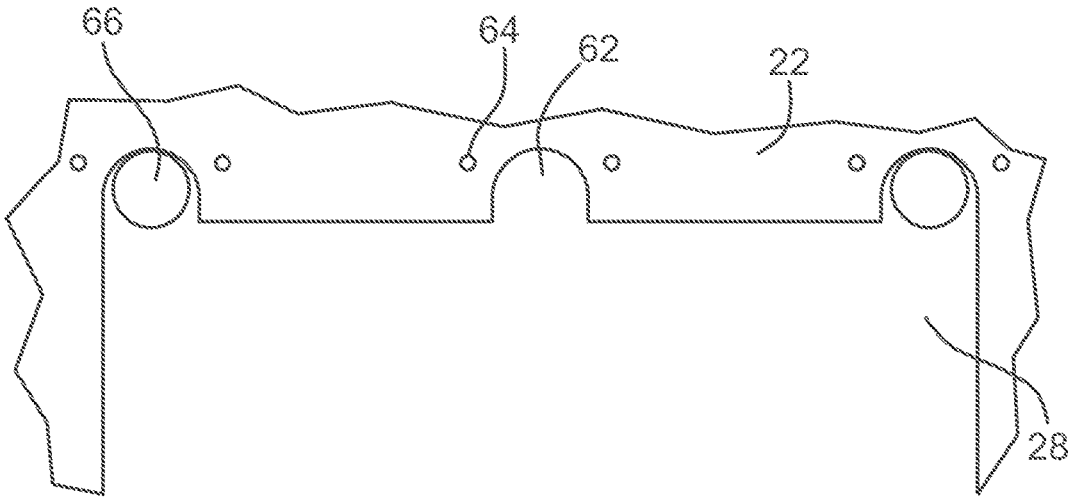
FIG. 13 is an enlarged view of the top portion of the generally rectangular hole of FIG. 12 and showing a rebar in each corner.
Figure 14:
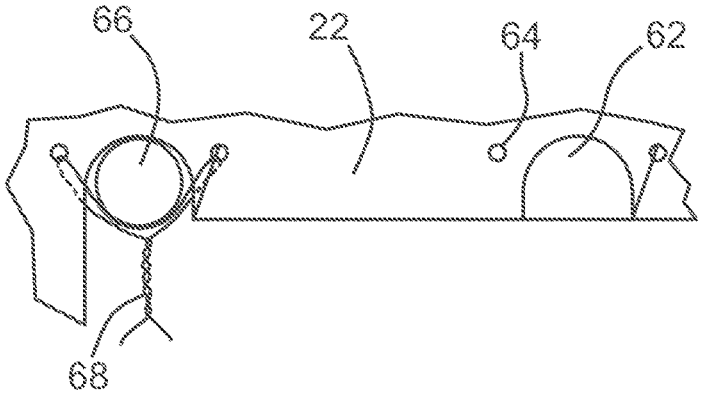
FIG. 14 is an enlarged view of the top corner of generally rectangular hole of FIGS. 12 and 13 and showing a rebar and a rebar tie.
Figure 15:
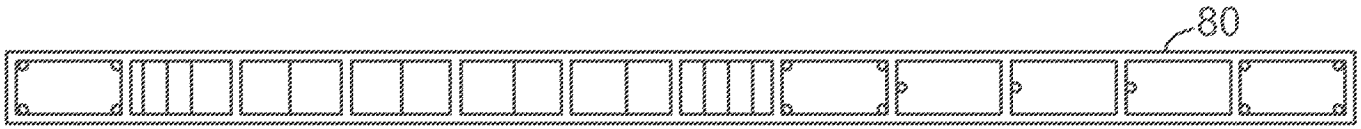
FIG. 15 is a top view of a wall of a formwork system.

Referring to FIGS. 12, 13 and 14, the hole 28 in the formwork studs includes a plurality of divots 62 spaced around the perimeter of the hole. The divots are shaped to receive a reinforcing bar 66 (rebar) shown in FIGS. 13 and 14. By way of example the generally rectangular hole 28 may have divots 62 in each corner thereof as well as divots 62 spaced apart along the sides, the top and the bottom. Proximate to each divot 62 there may be a pair of tie holes 64 configured to receive rebar ties 68. The divots 62 are positioned to hold the rebar in a precise location, typically arranged so that rebar can be installed to create continuous generally rectangular beams and columns throughout the wall. The positioning of the holes 28 and divots 62 are configured such that the formwork stud system described herein can be designed like a typical concrete wall, with readily accepted concrete design principles throughout the world. By way of example the divots 62 are positioned at the corners of the generally rectangular holes 28. As well, the divots are spaced apart along the sides and the top and bottom of the holes 28.

Figure 11:
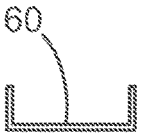
FIG. 11 is a top view of a formwork track for use in a formwork system.
Figure 16:
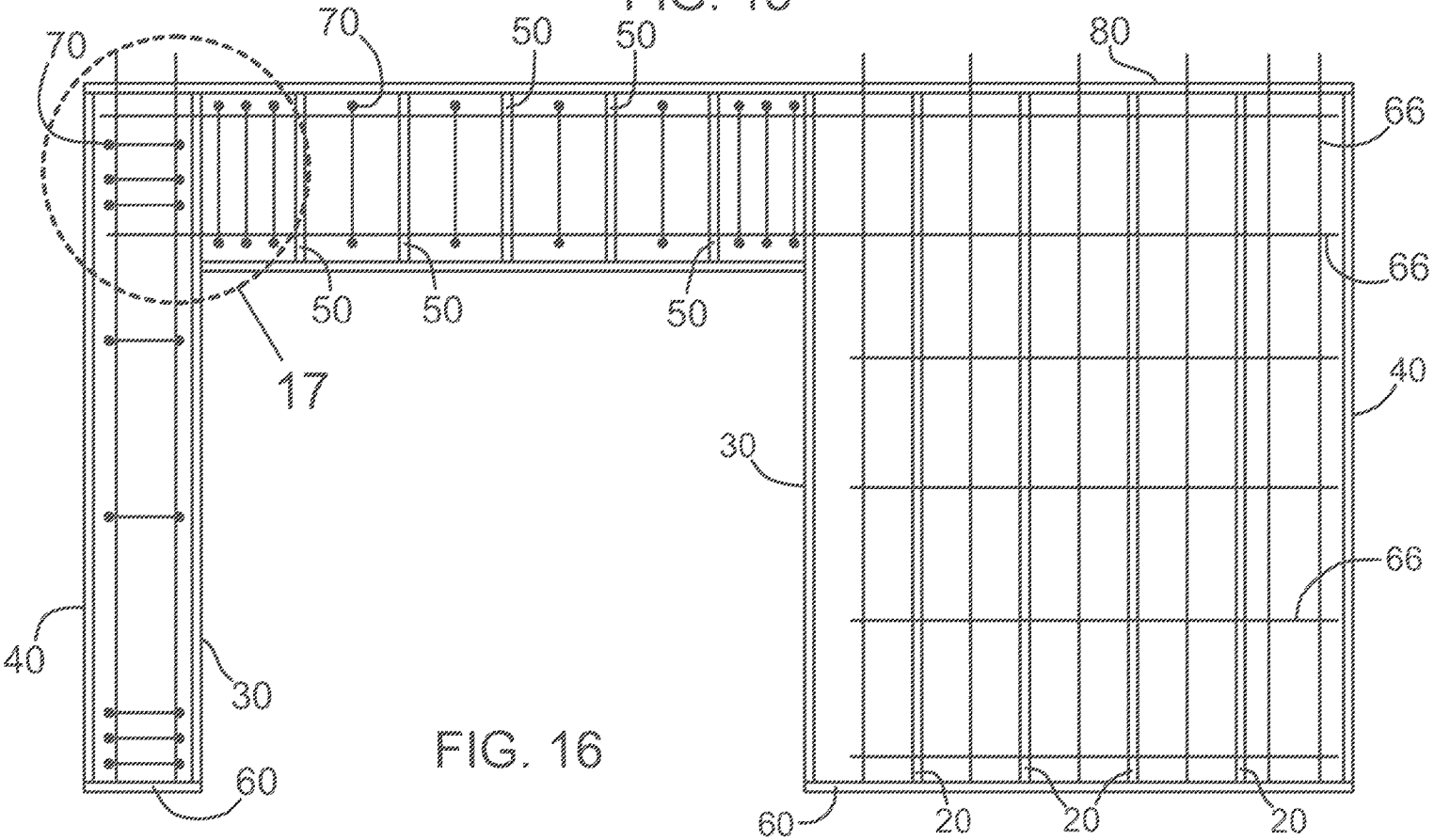
FIG. 16 is a front view of a wall of the formwork system of FIG. 15.
Figure 17:
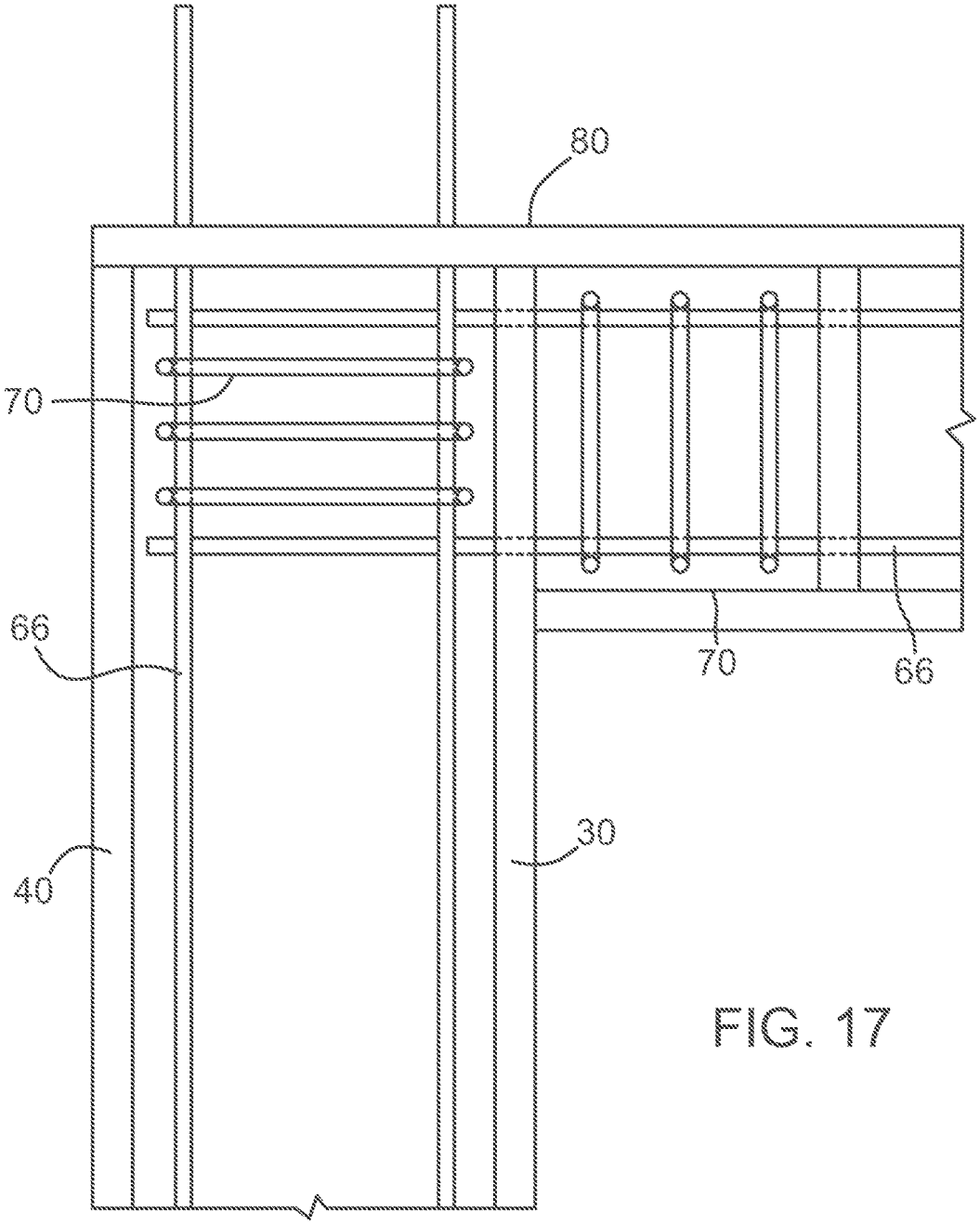
FIG. 17 is an enlarged front view of a corner of the wall of FIG. 16.
Figure 18:
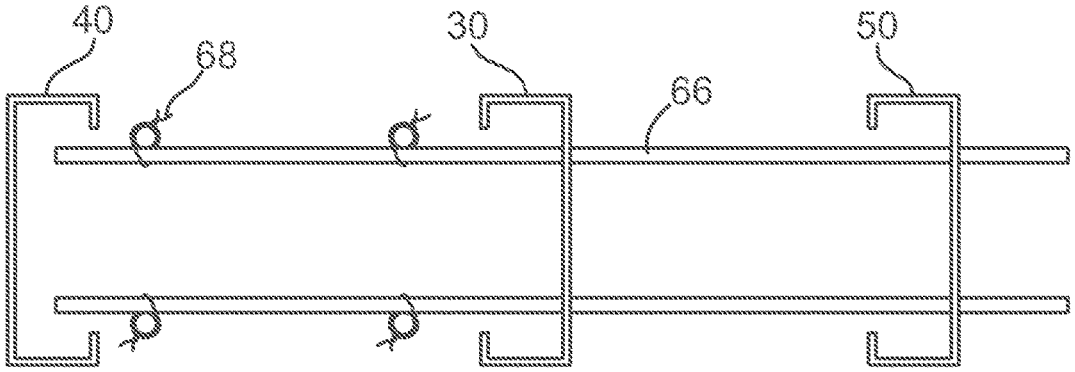
FIG. 18 is an enlarged sectional view of the corner of the wall shown in FIG. 17.
Figure 19:
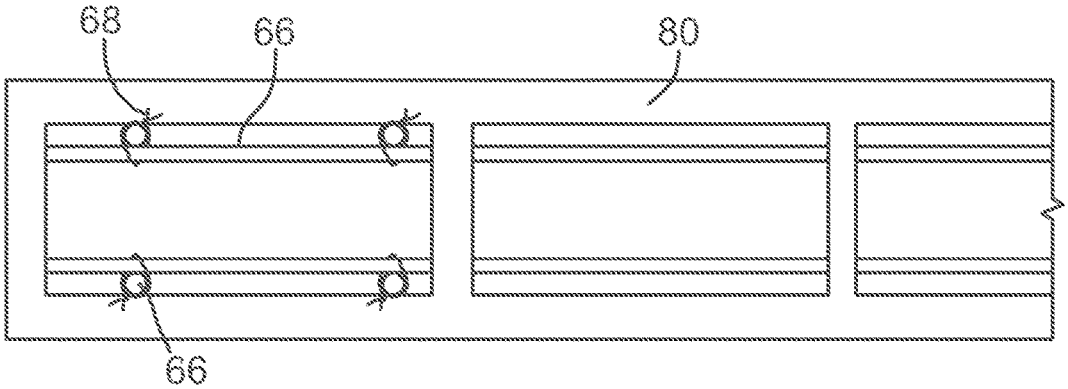
FIG. 19 is a top view of the corner of the wall shown in FIGS. 17 and 18.

An example of a formwork stud system is shown generally at 100 in FIG. 16. Formwork stud system 100 includes a plurality of formwork studs. In the example shown herein there are two end formwork stud 40 at opposed ends of the wall. A pair of formwork studs 30 are positioned at either side of the opening. A plurality of short formwork studs 50 are positioned above the opening. A plurality of formwork studs 20 are positioned between a formwork stud 30 and an end formwork stud 40. A plurality of vertical rebars are positioned between the formwork studs 20, 30, 40 and 50. A plurality of horizontal rebars extend through the holes 28 in adjacent formwork studs. The vertical rebars and the horizontal rebars may be tied together. In addition, rebar stirrups 70 may be used in conjunction with horizontal or vertical rebars. The formwork stud system includes a bottom track 60 and a top track 80. The top track 80 and bottom track 60 are generally C-shaped members as shown in FIG. 11. The top track 80 has a plurality of holes 28 formed therein similar to formwork stud 20. Similarly the bottom track 60 may have a plurality of holes 28 formed therein. The holes 28 in the top track 80 provide access to the inside of the walls so that concrete may be formed therein. Further holes 28 in the top track 80 allow for rebars 66 to extend therethrough so that they may be tied to the rebars 66 of the wall above.

Figure 20:
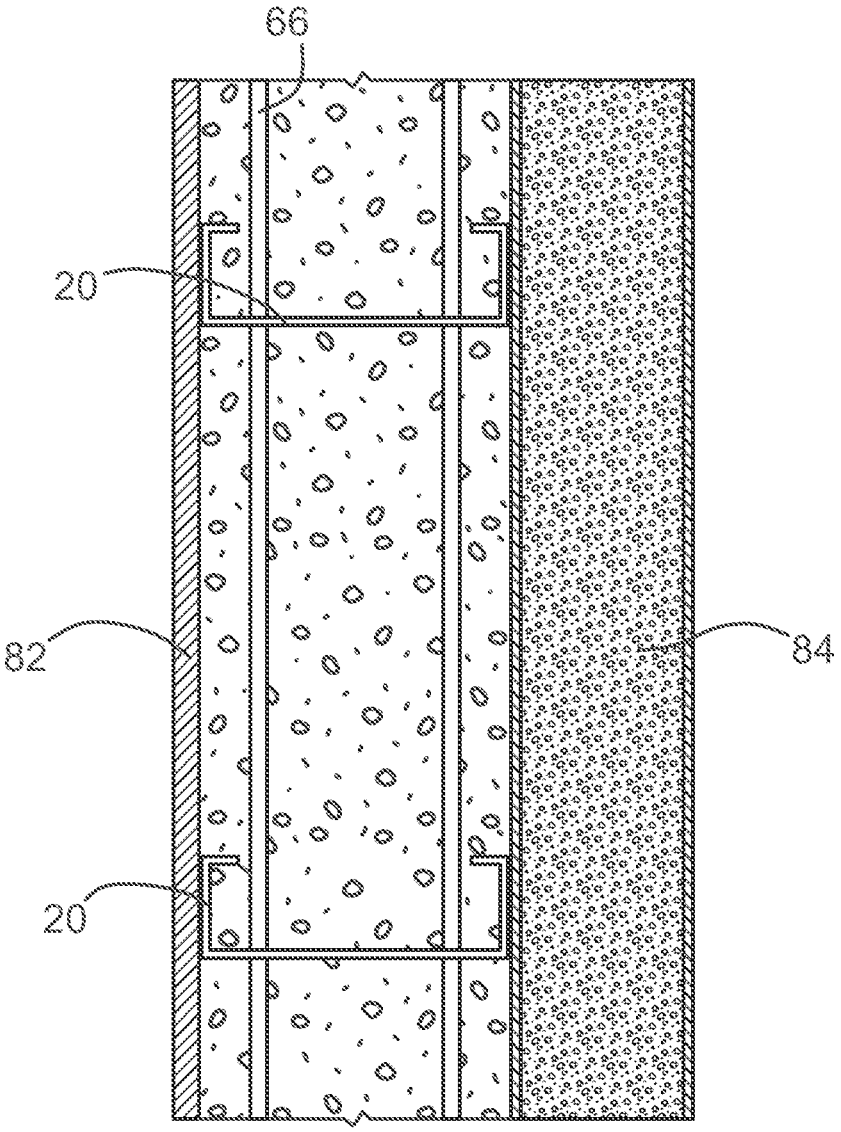
FIG. 20 is a horizontal section view of a portion of a wall of the formwork system with concrete therein.
Figure 22:
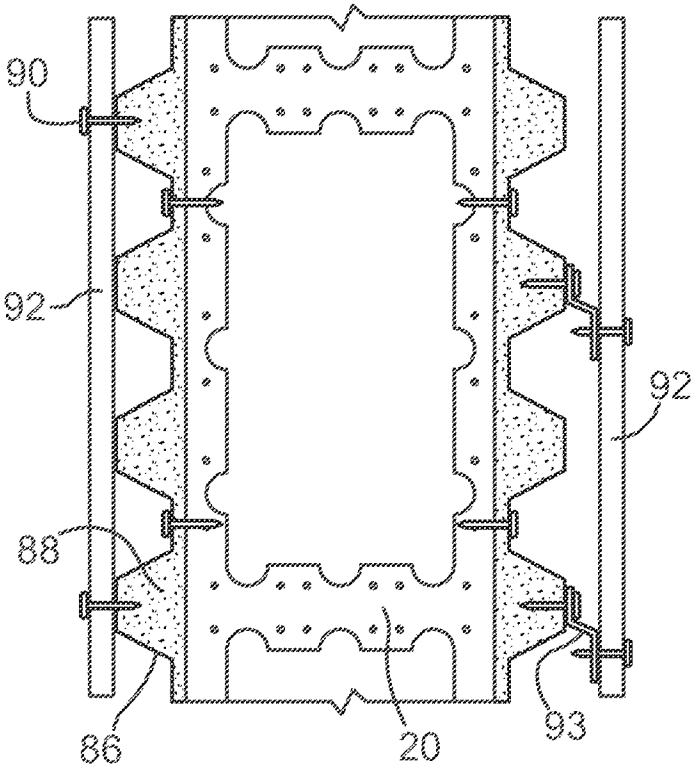
FIG. 22 is a side sectional view of a wall in a formwork system.
Figure 21:
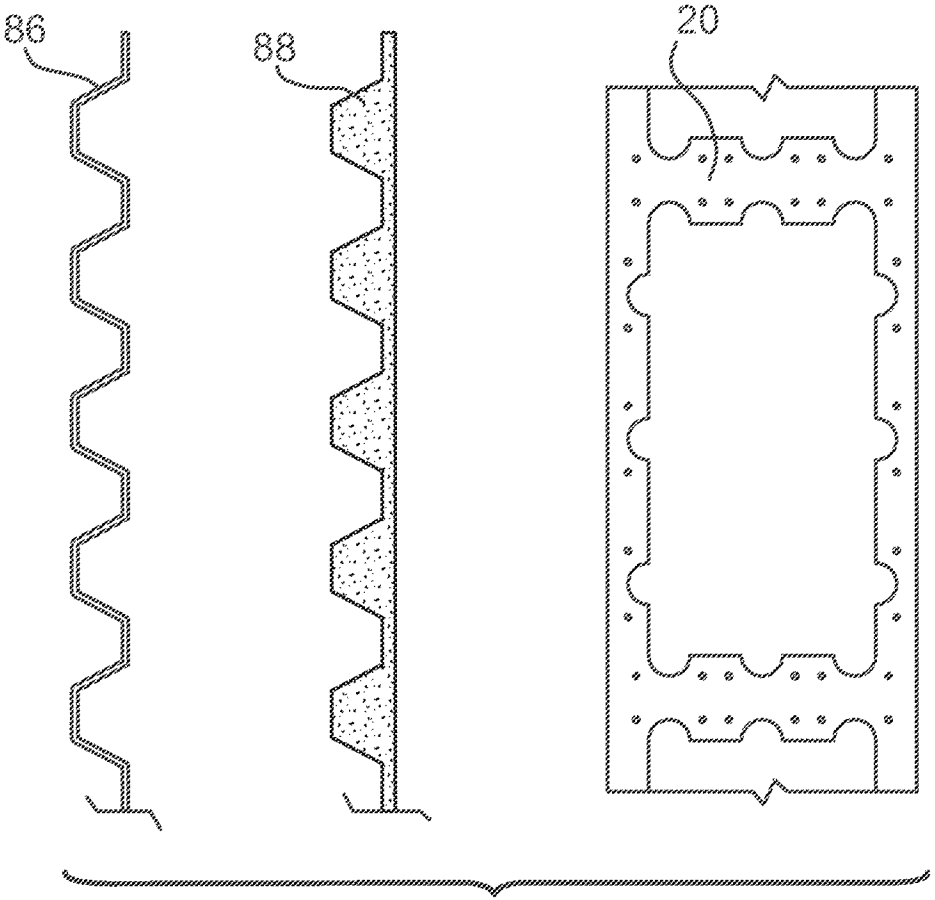
FIG. 21 is a blown apart side sectional view of a wall in a formwork system.

The formwork stud system 100 shown in FIG. 16 may be used with a variety of different structural walls. For example as shown in FIG. 20 it may be used with a structural board 82 or with foam filled panel with metal on either side thereof 84. Alternatively the wall may be include a corrugated wall 86 with a profiled foam rubber strip 88 in registration therewith as shown in FIGS. 21 and 22. The foam rubber strips 88 are placed between studs 22 and deck 86 to prevent concrete from filling the volume and allow screws to connect thereto. Plasterboard or other wall panels 92 may be attached to the deck or corrugated wall 86. Alternatively wall panels 92 may be attached to the corrugated wall 86 with resilient channels 93. The addition of resilient channels provide some noise reduction.

It will be appreciated by those skilled in the art that different types of sheeting may be attached to the formwork stud system 100. As described above the sheathing may be structural board 82, a foam filled panel with metal on either side thereof 84, a corrugated wall 86 with a profiled foam rubber strip 88 in registration therewith or other wall systems. All of the possible sheathings are similar in that they all have sufficient strength to retain concrete.

Figure 23:
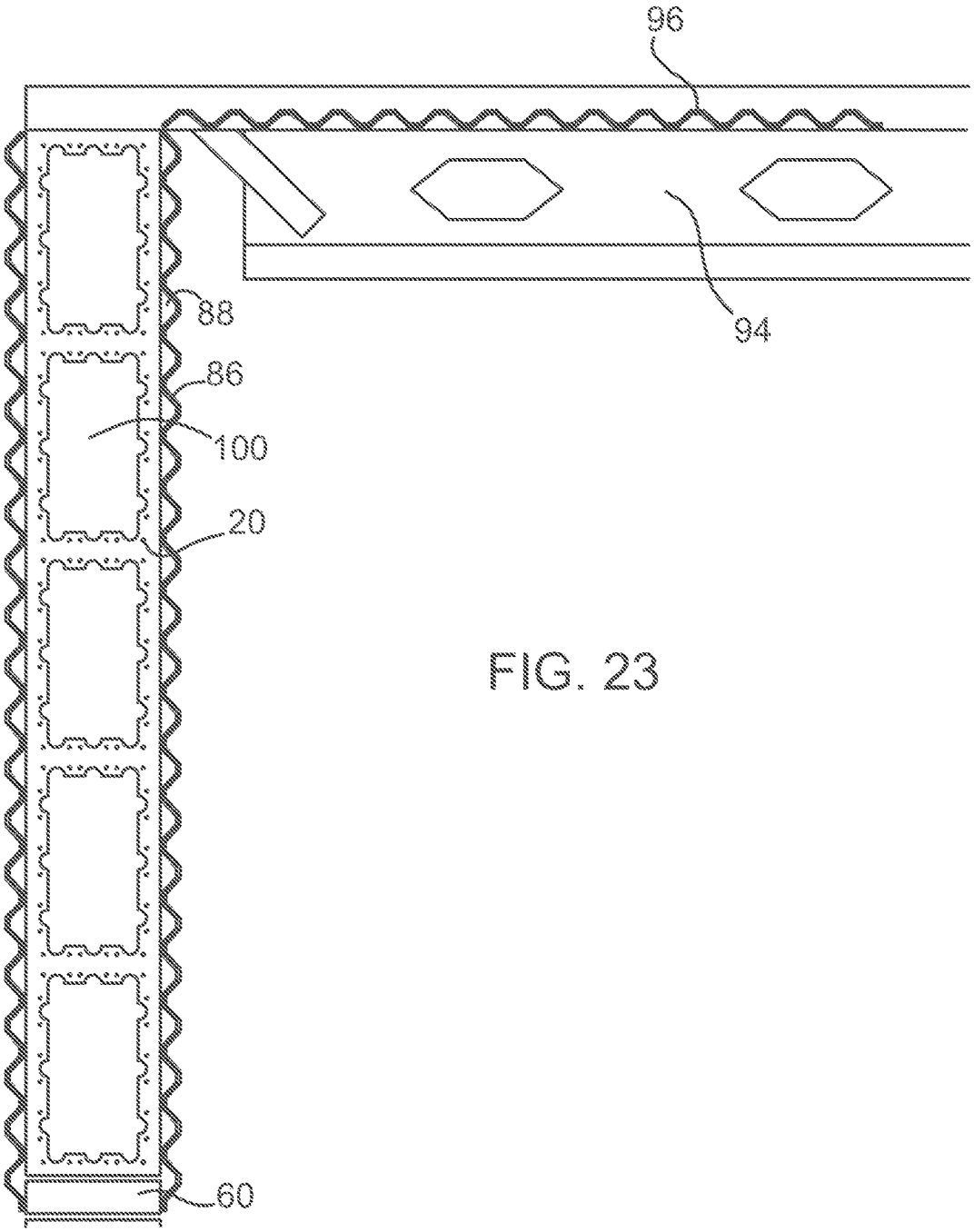
FIG. 23 is a side view of a wall in a formwork system and an upper floor.

Formwork stud system 100 may be used to construct a wall and it may be used in conjunction with steel joists 94 and a dovetail steel deck 96 as shown in FIG. 23. The joist shown in FIG. 23 is by way of example only and it will be appreciated by those skilled in the art that other types of joists would also work, such as open webbed steel joists or planar web joists for example.

The divots 62 have been developed in particular to help with construction of the wall, to create beams and columns provisions have been made to fix the rebar to the divots 62 with wire ties or bendable tabs. This formwork technology secures the rebar 66 in precise location and provides an ideal method to install rebar in the forming system off site. The sheathing described above may also be attached to the formwork stud system 100 off site. The sheathing may be attached on one or both sides or faces of the form work stud system. As well either full or partial sheathing may be attached to the formwork stud system 100. It will be appreciated that by assembling the form work system 100 off site this will reduce or eliminate the need for formwork trade on site. Further by attaching some or all of the sheathing off site, the need for those trades on site will also be reduced.

This formwork stud system 100 inherently provides the benefit of being able to set a floor framing on the forms prior to be poured to serve as winter protection. When using a metal deck profile 86, a profiled foam strip 88 can be placed under the deck at the stud locations, so that drywall and other attachments are easily made without having to drill into the concrete.

It will be appreciated by those skilled in the art that the system described herein allows for mass customization. With the system described herein an architect, engineer or other designer can design a concrete wall and with the formwork stud system 100, they can then design the specific studs that are needed to construct the wall. Once the specific studs have been designed they can then be manufactured.

Figure 24:
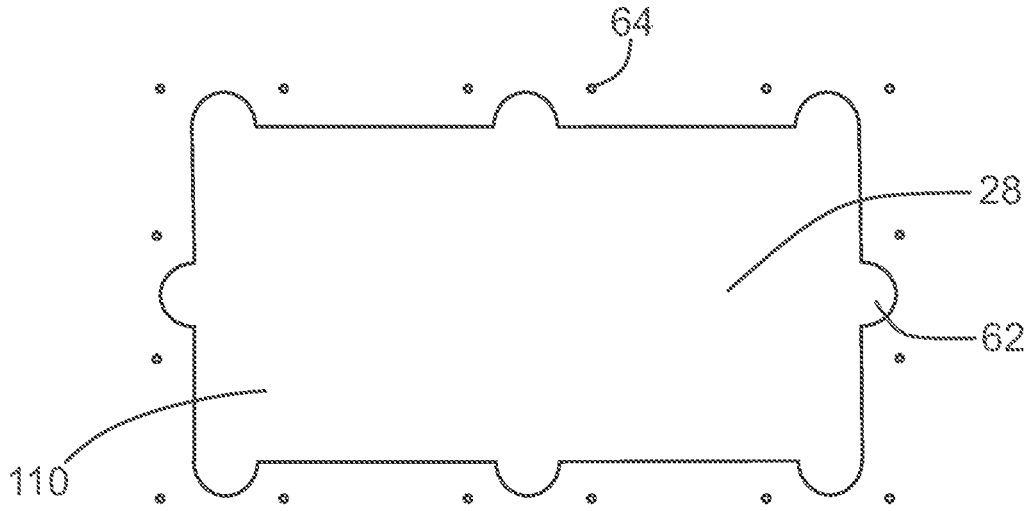
FIG. 24 is a top view of a single hole punch for use with the studs of FIGS. 7 and 9.
Figure 25:
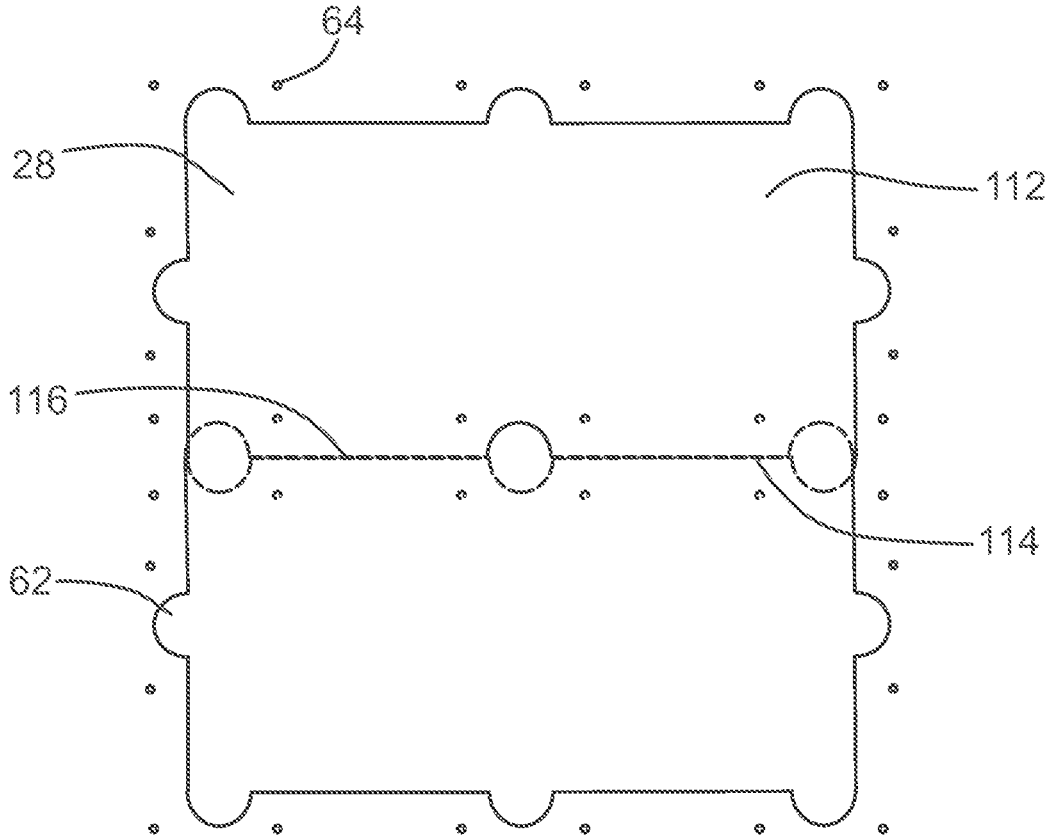
FIG. 25 is a top view of a hole punch similar to that shown in FIG. 24 but showing a double hole punch.
Figure 26:
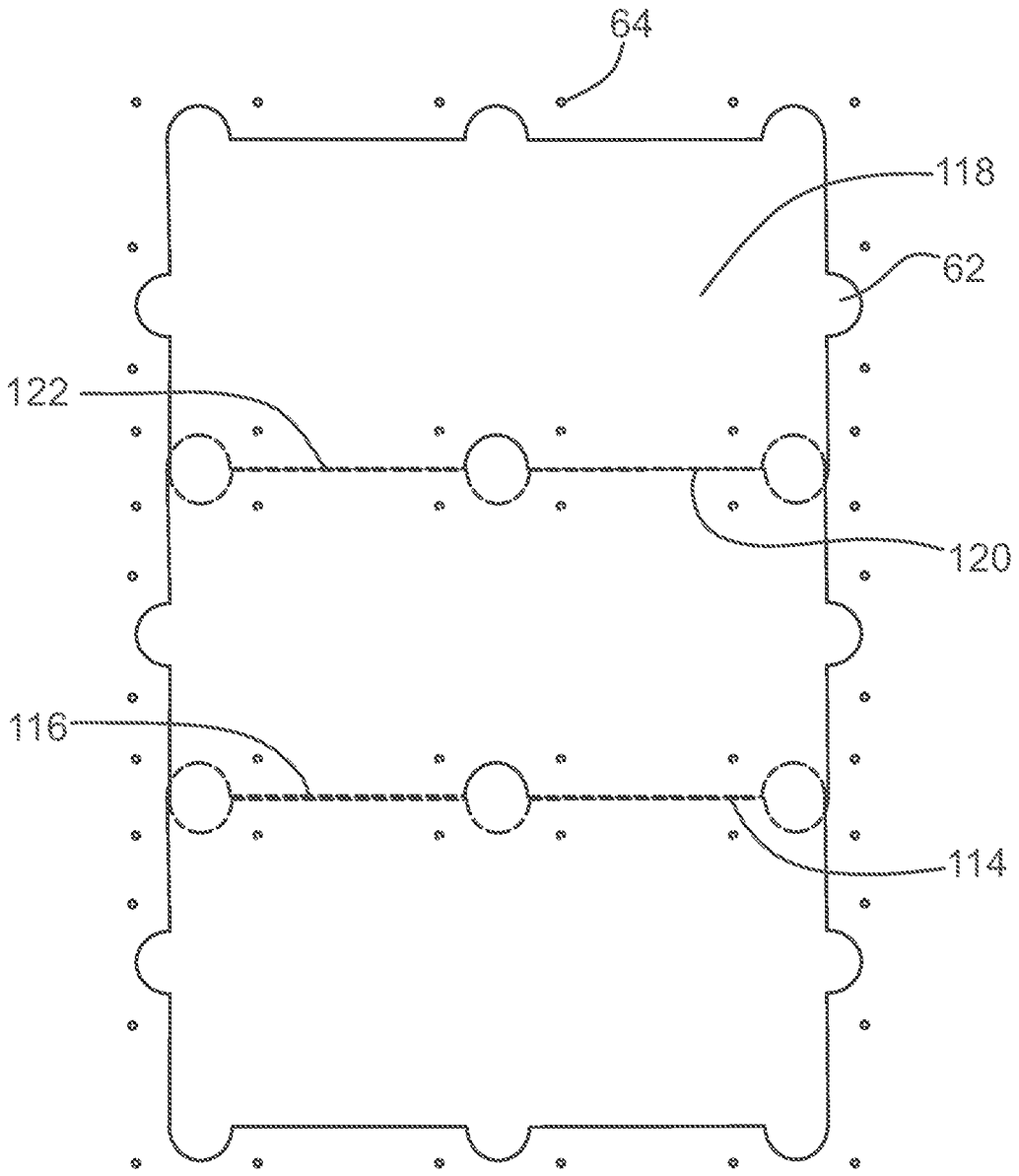
FIG. 26 is a top view of a hole punch similar to that shown in FIGS. 24 and 25 but showing a triple hole punch.
Figure 27:
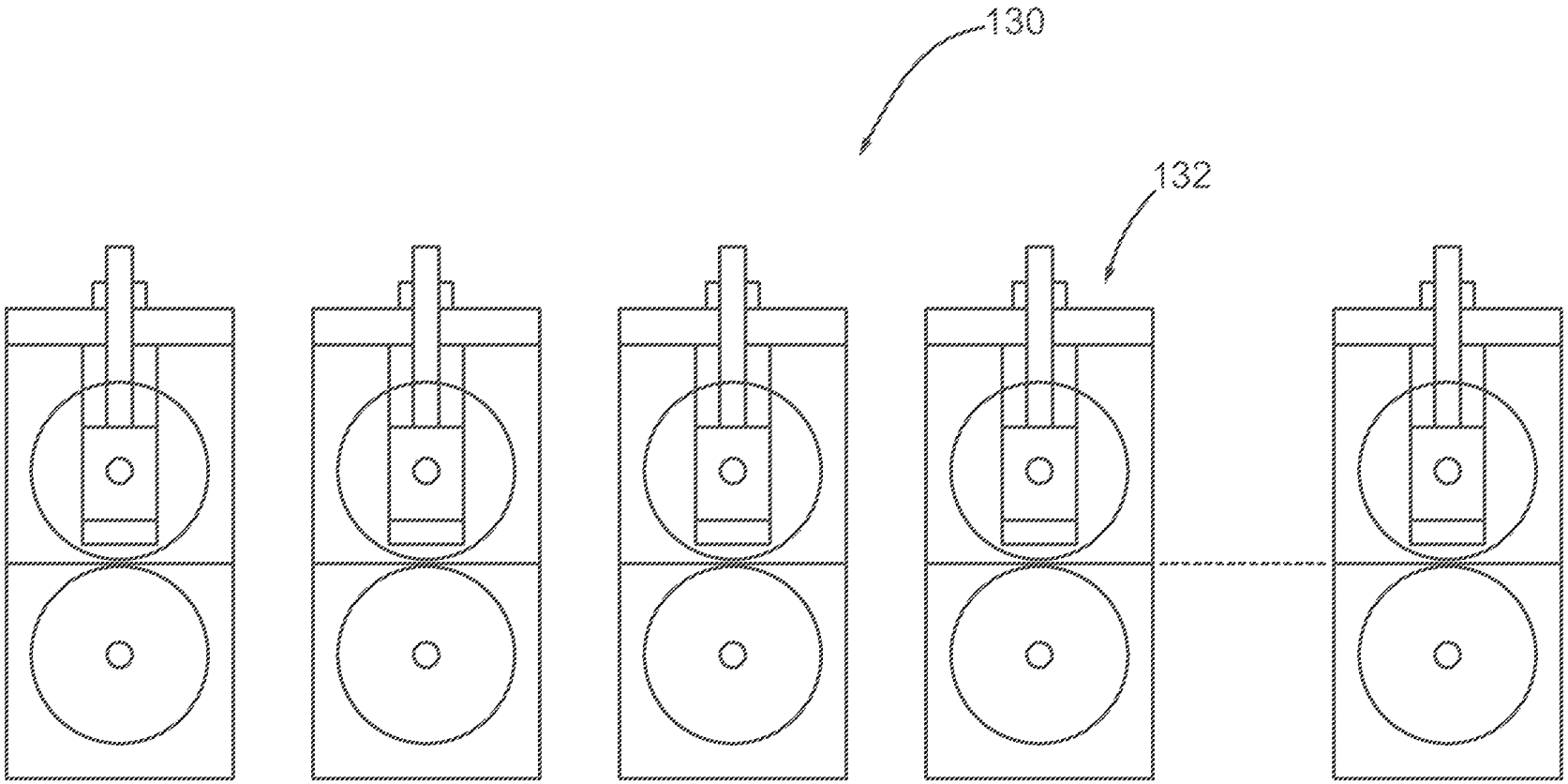
FIG. 27 is a side view of a plurality of roll forming stations.

Referring to FIGS. 24 to 26, the three different possible holes that can be made using a single punch are shown. FIG. 24 shows a hole 28 made from a single punch. As discussed above the hole 28 has divots 62 along the side. In the single punch embodiment 110 shown herein there is only one divot 62 along the side. Alternatively the hole 28 may be a double punch hole 112 with two divots 62 along the side. In the double punch embodiment 112 the top 114 of the first punch is aligned with the bottom 116 of the second punch. Another alternative hole 28 is shown in FIG. 26 which is a triple punch hole 118. In the triple punch hole 118 there are three divots 62 along the side. As discussed above with regard to the double punch hole 112, the top 114 of the first punch is aligned with the bottom 116 of the second punch and the top of the second punch 120 is aligned with bottom 122 of the third punch. One skilled in the art can see that by virtue of having this functionality in punching that pretty much any hole required can be provide.

The hole punching die geometry has been developed to provide customization to suit features such as windows doors, beams and columns. The stud is mass customized so that one die can produce different sizes of hole as need to suit inherent wall features such as windows doors and structural elements such as beams.

Figure 28:
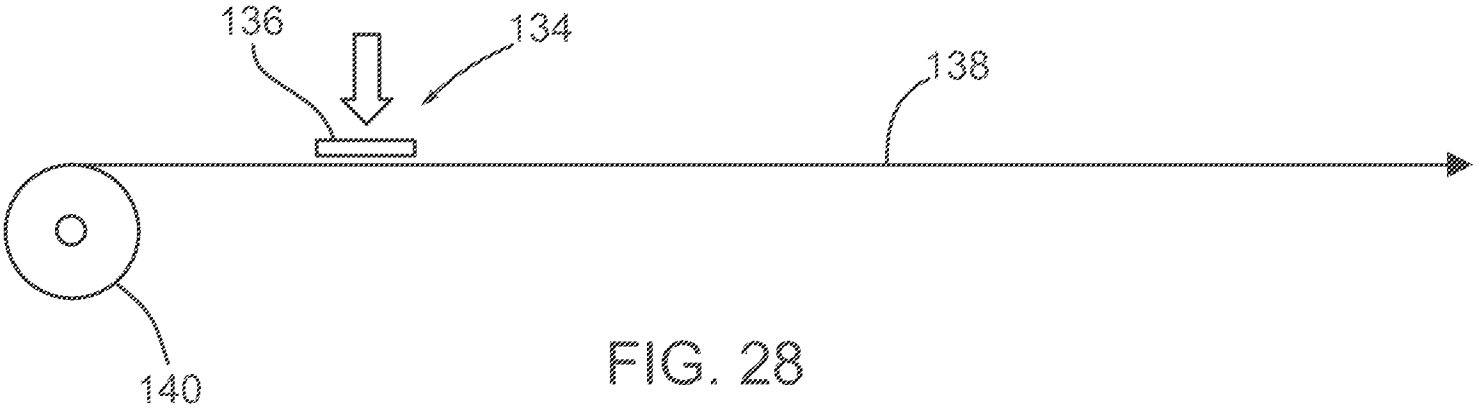
FIG. 28 is a side view of a hole punch line.
Figure 29:
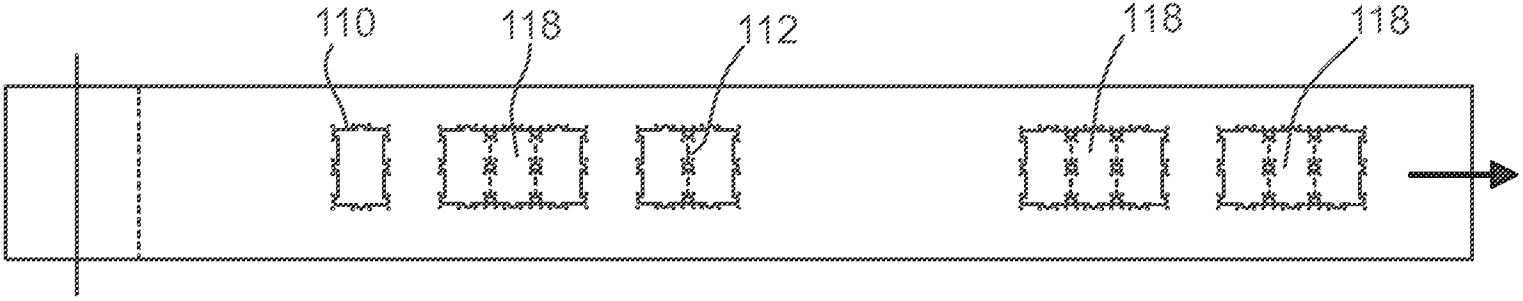
FIG. 29 is a top view of the hole punch line of FIG. 27.

By way of example, the different formwork studs described may be made in a roll forming process shown generally at 130. In the roll formed process the sheet material is passed through a series of roll forming stations 132. In one of the stations the opposed lips 26 are formed. In another station the opposed flanges 24 are formed therein. In another station the holes 28 are punched. The hole punching station is shown generally at 134 in FIG. 28. The hole punching stations 134 includes hole punch 136. The shape of the hole is described above with regard. The sheet material 138 passes under the hole punch 136 and at a prescribed location for the particular member being formed the hole punch 136 punches a hole. The sheet material continues to move through the station until the next hole needs to be punched. Different examples of holes punched can be seen in FIG. 29. The sheet material is typically cold rolled steel that is initially provided to the roll forming process in a roll 140.

Generally speaking, the systems described herein are directed to metal studs and metal stud systems. Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

What is claimed is:

1. A formwork stud system for use in association with concrete comprising;

a plurality of studs wherein at least one of the plurality of studs is a formwork stud having:

a web having opposed side portions extending from the top of the formwork stud to the bottom of the formwork stud and a plurality of lateral spaced apart connectors extending between the opposed side portions whereby the opposed side portions and the lateral spaced apart connectors define a plurality of spaced apart holes and the holes are configured to allow concrete to flow therethrough and the holes include a plurality of divots and a plurality of tie holes proximate to each of the divot, the web defining a vertical face, whereby the holes, divots and tie holes are formed in the vertical face;

a pair of flanges extending generally orthogonally from the opposed side portions of the web;

a top channel;

a bottom channel;

a plurality of rebar ties configured to be positioned in the tie holes;

a plurality of horizontal and vertical rebars, wherein the horizontal rebars are positioned in the divots of the plurality of spaced apart holes in the formwork stud and configured to be tied in place with rebar ties, the vertical rebars are positioned between the plurality of studs and the horizontal and vertical rebars configured to be tied together with rebar ties; and wherein the formwork stud system in conjunction with concrete forms a concrete wall.

2. The formwork stud system of claim 1 wherein the plurality of studs have opposed faces and further including sheathing attached to at least one face of the plurality of studs.

3. The formwork stud system of claim 2 wherein the plurality of studs have sheathing on both of the opposed faces of the plurality of studs.

4. The formwork stud system of claim 2 wherein the sheathing is structural board.

5. The formwork stud system of claim 2 wherein the sheathing is a foam filled panel with metal on either side thereof.

6. The formwork stud system of claim 2 wherein the sheathing is a corrugated wall.

7. The formwork stud system of claim 6 wherein the corrugated wall includes a profiled foam rubber strip.

8. The formwork stud system of claim 1 wherein the formwork stud system is constructed off site.

9. The formwork stud system of claim 2 wherein the formwork stud system is constructed off site.

10. The formwork stud system of claim 1 wherein the holes are generally rectangular.

11. A formwork stud for use in association with concrete, rebars to form a concrete wall, and rebar ties, the formwork stud comprising:

a web having opposed side portions extending from the top of the formwork stud to the bottom of the formwork stud and a plurality of lateral spaced apart connectors extending between the opposed side portions whereby the opposed side portions and the lateral spaced apart connectors define a plurality of spaced apart holes and the holes are configured for rebars to be positioned therein and to allow concrete to flow therethrough and the holes include a plurality of divots and a plurality of tie holes proximate to each of the divot for receiving rebar ties, the web defining a vertical face, whereby the holes, divots and tie holes are formed in the vertical face; and a pair of flanges extending generally orthogonally from the opposed side portions of the web.

12. The formwork stud of claim 11 wherein the web has between 70 and 90% removed to form the plurality of spaced apart holes.

13. The formwork stud of claim 11 wherein the web has 85% removed to form the plurality of spaced apart holes.

14. The formwork stud of claim 11 further including a pair of opposed lips extending inwardly from the pair of flanges.

15. The formwork stud system of claim 1 further including a plurality of rebar stirrups for use in conjunction with one of the horizontal rebars, vertical rebars or horizontal and vertical rebars.

* * * * *